US008167164B2

(12) United States Patent
Peterson

(10) Patent No.: US 8,167,164 B2
(45) Date of Patent: May 1, 2012

(54) SPILL RESISTANT TILTABLE PAINT PAN

(76) Inventor: Mark Peterson, Hermitage, TN (US)

( * ) Notice: Subject to any disclaimer, the term of this patent is extended or adjusted under 35 U.S.C. 154(b) by 0 days.

(21) Appl. No.: 12/806,713

(22) Filed: Aug. 19, 2010

(65) Prior Publication Data

US 2011/0041281 A1 Feb. 24, 2011

Related U.S. Application Data

(60) Provisional application No. 61/235,435, filed on Aug. 20, 2009.

(51) Int. Cl.
*B05C 21/00* (2006.01)

(52) U.S. Cl. ..... 220/570; 15/257.06

(58) Field of Classification Search ..... 220/570, 220/571; 15/257.01, 257.06
See application file for complete search history.

(56) References Cited

U.S. PATENT DOCUMENTS

| | | | | |
|---|---|---|---|---|
| 3,602,939 | A * | 9/1971 | Schoenholz | 15/257.06 |
| 3,732,593 | A * | 5/1973 | Habostad | 15/257.06 |
| 5,787,544 | A * | 8/1998 | Meade | 15/257.06 |
| 6,493,901 | B1 * | 12/2002 | Jones | 15/257.06 |
| 7,311,219 | B1 * | 12/2007 | Kallas et al. | 220/570 |
| 2006/0225959 | A1 * | 10/2006 | Pohl | 182/129 |

* cited by examiner

*Primary Examiner* — Harry Grosso
(74) *Attorney, Agent, or Firm* — Mark Manley

(57) ABSTRACT

A paint pan has a generally rectangular box shape and an inclined rub plate extends down into the pan from a front wall. A partial roof extends from the top edge of the back wall, and a partial opening is formed generally above the rub plate and between the top edge of the front wall and the partial roof. When the pan is in a "use" position, paint may be poured into the pan through the partial open roof and it will flow to the floor. The pan is dimensioned so that a roller brush may be inserted through the partial opening to the floor of the pan beneath the partial roof. A handle is provided on the front wall and when the pan is lifted by the handle, paint flows into a storage volume defined in part by the floor, a left wall, a right wall, the back wall and partial roof.

10 Claims, 6 Drawing Sheets

SPILL RESISTANT TILTABLE PAINT PAN

RELATED APPLICATION

This application claims priority under 35 USC 119(e)(i) to provisional U.S. patent application 61/235,435 filed Aug. 20, 2009 and having the same title.

FIELD

This invention relates to the field of paint containers. More particularly, this invention relates to a spill resistant paint pan that can be rotated from a use position ninety degrees to a carry position and carried with one hand.

BACKGROUND

Paint pans are commonly used when applying paint with a roller brush and many designs are available. However, there remains a need for a spill resistant pan that allows easy portability with good resistance to spillage.

SUMMARY

The above and other needs are met by a spill resistant paint pan that has an integral handle on one end of the pan and a reservoir on the opposite end of the pan from the handle. The reservoir is configured to receive and hold paint when the pan is lifted by the handle, and the pan is configured to tilt away from the handle and toward the reservoir when the pan is lifted vertically by the handle, that is to say the pan rub plate slopes away from the handle and towards the reservoir. The pan includes a flexible lid that snaps onto a peripheral lip surrounding an opening that provides access to the reservoir to a paint tool such as a paint roller, pad or brush.

In accordance with one embodiment of the invention, a paint pan has a generally rectangular box shape with a rectangular top, rectangular floor and four walls extending upwardly from the floor to the top to create the box shape. For identification purposes only, the walls are designated herein as a front wall, left wall, right wall, and back wall. A recess is formed in the front wall and a handle is formed in the recess. A rub plate extends at a downward inclination angle starting at the top of the front wall and extending down into the pan towards the floor, and ribs are formed on the rub plate for engaging a roller paint brush and squeezing excess paint from the roller brush. Lateral edges of the rub plate may be joined to the left and right walls for support. A top in the form of a partial roof extends from the top edge of the back wall and along the left and right wall for a distance of about one third of the distance from the back wall to the front wall, and a recess is formed in the partial roof for holding a paint tool such as a roller brush. An opening is formed generally above the rub plate and between the top edge of the front wall and the partial roof. The opening has a generally planer peripheral edge such that a flexible lid can placed in sealing engagement with the partial opening to seal the pan closed.

When the pan is in the "use" position, the floor is disposed in a horizontal position such as by positioning the pan's floor on the floor of a building or on a horizontal surface. In this use position, paint may be poured into the pan through the partial open roof and it will flow to the floor. The pan is dimensioned so that a roller brush may be inserted through the partial opening to the floor or the pan beneath the partial roof. Thus a roller brush may pick up the paint within the can and squeeze the excess paint from the brush by rolling the brush on the ribs of the rub plate. Ample room is provided between the rub plate and the partial roof to allow a variety of roller brush sizes to pass into the pan conveniently.

The pan may be carried in a "carry" position by grasping the handle and lifting the pan. When lifted, the pan will tilt until the floor is vertical and the front and back walls are horizontal. In this position, the paint flows along the floor and into a reservoir defined by the floor, left wall, right wall, back walls and partial roof. This reservoir may be dimensioned to easily hold one gallon of paint with plenty of lip to avoid sloshing the paint from the pan while it is carried by the handle.

A drain hole and plug may be provided so that the paint may be conveniently drained from the pan into a can or another paint receptacle. Preferably the drain hole is formed in the left wall immediately adjacent the back wall and the floor. The plug may be inserted and fixed in the hole from the inside or the outside of the pan. A locking mechanism may be provided to lock the plug in position so that it is not accidentally removed while the pan is in use.

Mounts may be provided in four corners of the floor to provide level sturdy mounting positions for four short supports or for mounting slides or castor wheels on the pan. With or without slides or castor wheels, the pan may be moved horizontally along a floor by simply pushing it, such as by pushing it with a roller brush.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
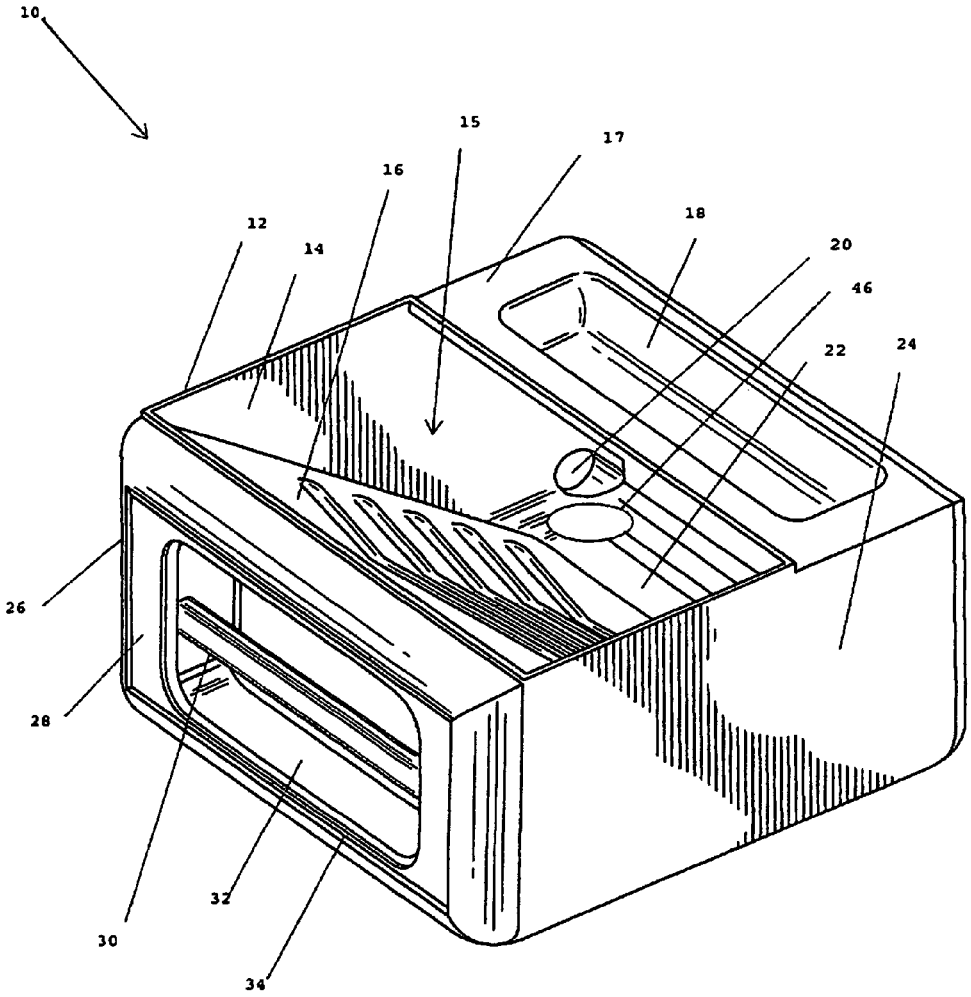
FIG. 1 is s perspective view of a paint pan from the front showing a handle.
Figure 2:
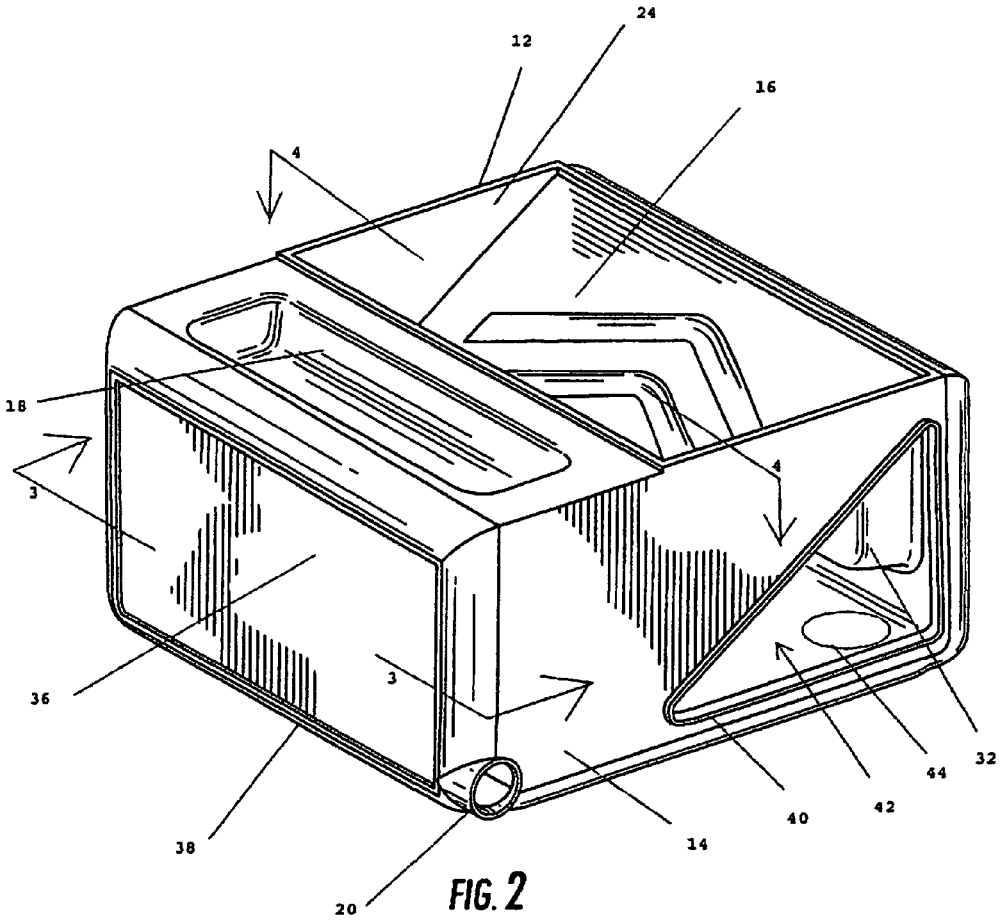
FIG. 2 is a perspective view of a paint pan from the rear.

Referring now to FIGS. 1 and 2, perspective views of pan 10 are shown representing one exemplary embodiment of the invention. FIG. 1 may be thought of as a front perspective view and FIG. 2 as a rear perspective view, but it will be understood that front and rear (or back) and left and right are being used as relative terms for convenient reference and any side could be defined as a front, left or other side. The box shaped pan 10 includes a front wall 28, left wall 14, right wall 24, rear wall 36 (FIG. 2) floor 22 and partial roof 17. An integral carrying handle 30 is formed into the front wall 28 and a recess 32 is provided to enclose the handle and isolate it from the interior of the pan 10. The handle 30 is in the form of a cylinder so that the surface of the handle 30 will allow the pan 10 to rotate about an axis of the handle 30 as the pan is lifted. Placing the handle in a recess 32 conceals the handle and prevents a user from stepping on the handle which could cause a spill. An inclined rub plate 16 is formed in the pan 10 extending generally from adjacent the top edge of the front wall 28 and extending downwardly and inwardly with the sides of the inclined plate 16 being attached to and supported by the walls 14 and 24.

In use, paint may be poured onto the inclined plate 16 through an opening 15 in the roof or top of the pan 10. The paint flows down the plate 16 and onto the floor 22 where it is contained by the pan 10. The paint may be accessed by inserting a conventional paint roller brush (not shown) between the plate 16 and the roof 17 and dipping the roller brush into the paint. Excess paint is removed from a roller brush by rolling or rubbing the brush across the plate 16. To prevent drying and contamination of the paint, a lid 60 (see FIG. 6) can be attached to lip 12 to seal the pan.

Figure 3:
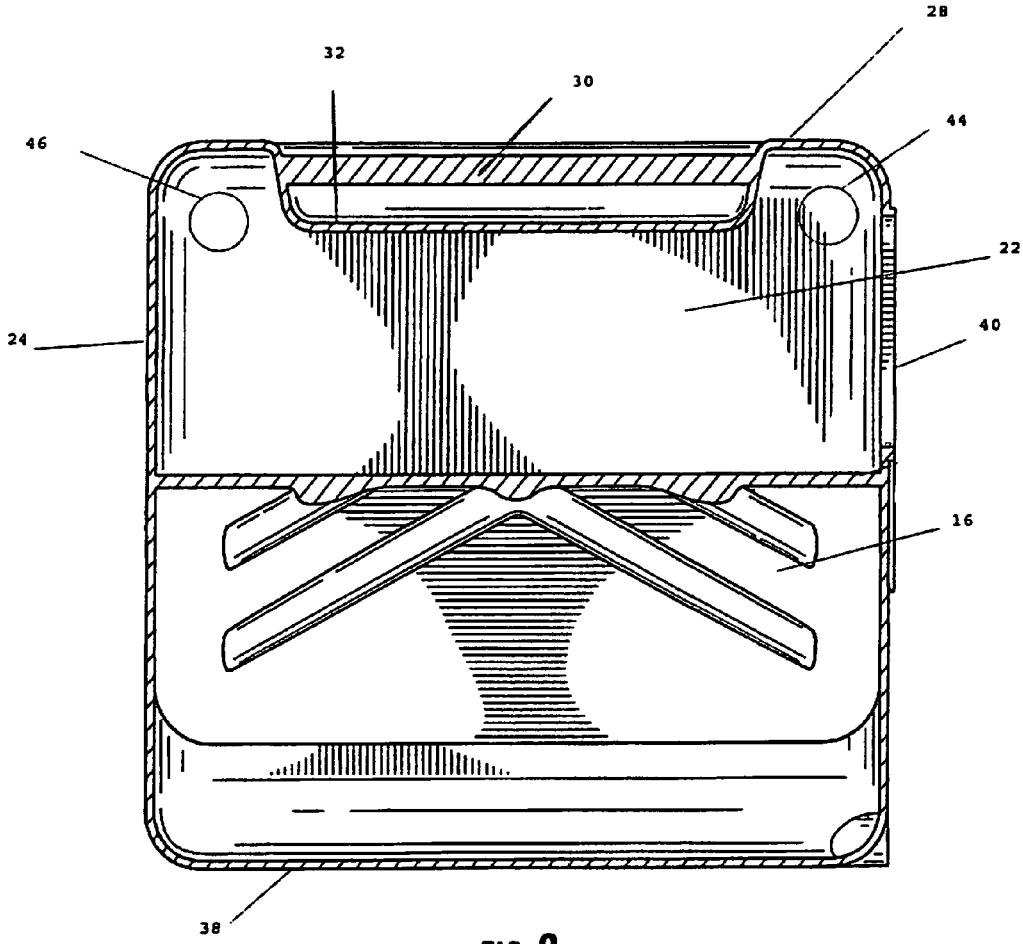
FIG. 3 is a cross sectional plan view of the pan with the section taken through line 3-3 in FIG. 2.

To carry the pan 10 to a new location, the pan 10 may be lifted by the carrying handle 30 and the pan 10 is tilted until the rear wall 36 is horizontal and the paint flows into the volume defined by the left, right and rear walls (14, 24 and 36) and the partial roof 17. This volume may be sized to comfortably hold a gallon of paint with about one and a half inches of brim to minimize sloshing or spillage while carrying. Referring to FIG. 2, a level perimeter 38 is formed around the periphery of the wall 36 to provide a level and stable footing for the pan 10 when it is carried and then placed on a floor in a carry position as shown in FIG. 3.

A drain hole 20 is formed in the left wall 14 adjacent to the floor 22 of the pan 10. To remove paint from the pan 10, a plug 50 (shown in FIG. 5) is removed from the hole 20 and the pan is lifted and tilted toward the rear wall 36 and the hole 20.

As shown in FIG. 2, a storage volume 44 is provided beneath the inclined plate 16 with access provided to the storage volume 44 by a lid covered opening 40 formed in the left wall 14. The storage volume has a triangular cross section and is used to store painter supply items such as rags, tape and the like, a flexible triangular lid (not shown) can cover the opening 40.

The pan 10 is typically used with roller brushes and a recess 18 is formed in the partial roof 17 for snuggly receiving a roller portion of a roller brush for storage. The pan 10 would likely be sold with a roller brush located in the recess 18. Also, the paint pan 10 may be mounted on short legs or caster wheels so that the pan may be scooted or rolled on the floor as it is used. To accommodate the mounting of legs or caster wheels, mounting pads, such as pads 44 and 46 are provided in the four corners of the floor 22. Such pads are thickened or reinforced level areas on the floor 22 where mounts or caster wheels may be mounted. Experience shows that the pan can be moved by hooking the roller under the partial lid 17 or by pushing against the back wall 36 with the roller, thus the pan 10 can be moved about the work site without bending over to pick it up.

Figure 4:
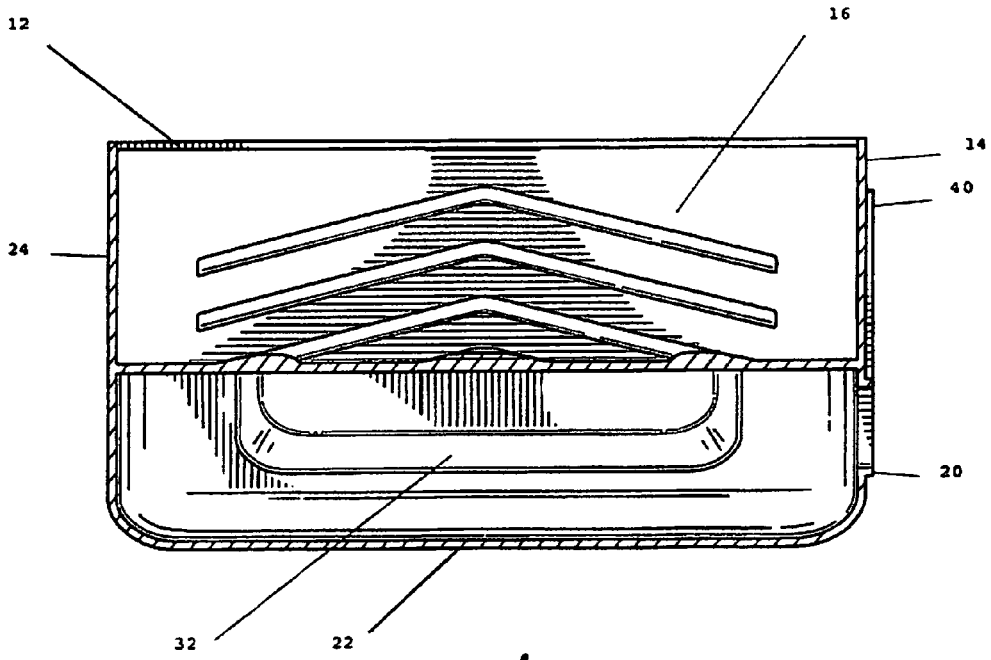
FIG. 4 is a side cross sectional view of the pan with the section taken through line 4-4 in FIG. 2.

Further details of the pan 10 may be observed by reference to the plan cross sectional view of FIG. 3 and the side cross section view of FIG. 4 that are taken through cross section lines 3-3 and 4-4, respectively, as shown in FIG. 2. In FIG. 3 about two-thirds of the inclined plated 16 is shown with the bottom portion cut away to reveal more of the floor 22. In this view it is shown that the handle 30 is enclosed in a recess 32 that isolates the handle 30 from the interior of the paint pan 10. Also, the shape of the mounting pads 44 and 46 are shown to be circular. In FIG. 4, again, about two thirds of the inclined plate 16 is shown and further details of the drain hole 20 are visible.

Figure 5:
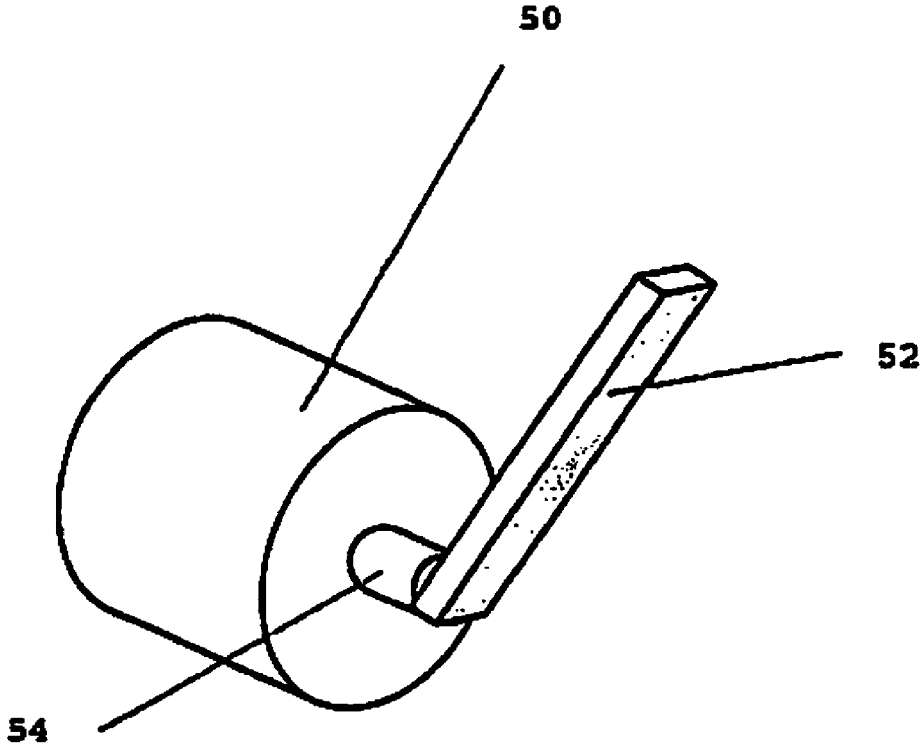
FIG. 5 is a diagrammatical illustration of a plug for plugging a hole in the paint pan.

In FIG. 5, an exemplary drain plug 50 is diagrammatically shown having a circular cross sectional configuration sized to fit with the hole 22. The plug 50 includes a lever 52 (diagrammatically shown) that moves to a perpendicular position as shown in FIG. 5 in which it pulls on the stem 54 and causes the plug 50 to expand and plug the hole 22. When the lever 52 is moved into a position parallel to the stem 54, it releases pressure on the stem 54 and allows the plug to elongate and the diameter of the plug decreases. The plug 50 is inserted into the hole 22 with the lever in the parallel position and, once inserted, the lever 52 is moved to the perpendicular position to expand and plug the hole 22. As the lever 52 moves from the parallel to the perpendicular position, it moves across an over-the-center position so that the plug is resiliently held in the closed position and considerable force is required to move the lever 52 back to the parallel position. In this manner, the level 52 "locks" in the closed or plugged position. Plug 50 is typically used to plug the drain hole in boats, but it is also well suited for this application because it is highly resistant to unintentional removal which could cause the paint to spill in this case.

Thus it is seen that the pan 10 provides a convenient mechanism for providing paint during a roller brush painting session. The spacing between the inclined plate 16 and the partial roof 17 is sufficiently large to allow easy access to the paint in the pan 10 using a wide variety of brushes and rollers. However, the partial roof is sized large enough to allow easy spill resistant carrying of the pan 10 by the handle 30. The drain hole 20 allows a quick and spill resistant way to remove the paint and clean up water or solvents from the pan 10, and ample accessory storage is also provided by the triangular storage volume 42. The box shaped pan 10 can be formed from molded components assembled together.

Figure 6:
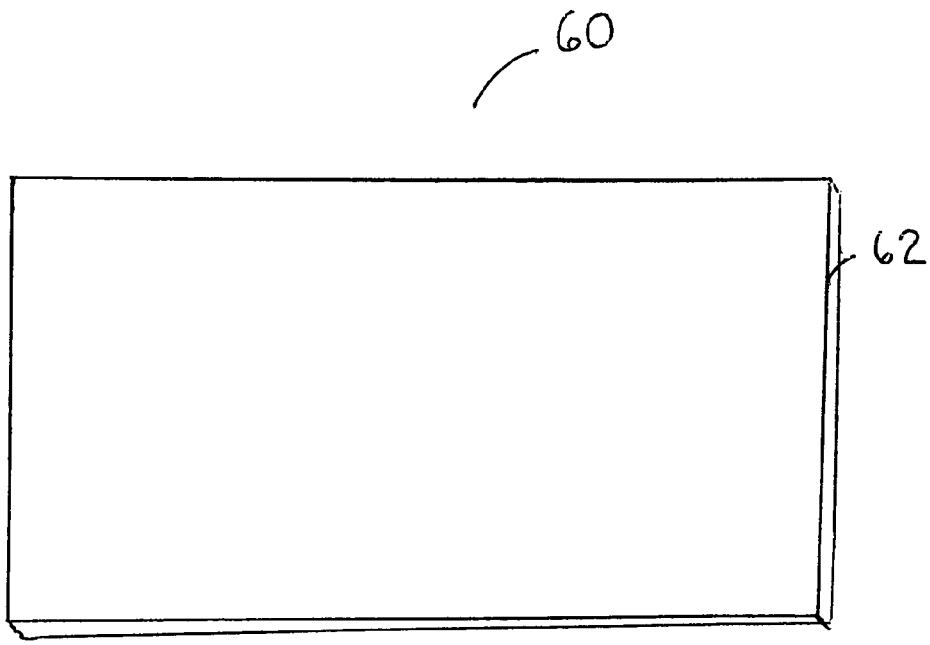
FIG. 6 shows a lid for use on the pan.

FIG. 6 shows a flexible lid 60 that can be applied to the periphery of opening 15 to seal the pan 10 to avoid paint drying. When the pan 10 is opened the lid 60 can be placed on another location on the pan 10 sized to receive it, for example the periphery 38 can be the same size as the periphery lip 12 of opening 15 for storage. The lid 60 may also be attached to the underside of the floor 22 such that the pan 10 would be sitting on the lid 60 in the view of FIG. 1. The lid 60 can include a flexible lip 62 that allows it to attach over the peripheral lip 12 of the opening 15. When the lid 60 is snapped in place on said peripheral lip 12 it forms a closed box sealed against drying of paint and contamination.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

I claim:

1. A spill resistant paint pan comprising:

a handle on one end of a box shaped pan, said box shaped pan including a partial top, four walls and a bottom;

a reservoir on an opposite end of the pan from the handle, the pan configured to receive and hold paint when the pan is lifted by the handle, and the pan including a rub plate tilted away from the handle and toward the reservoir, the pan including an opening in said partial top, said opening above a rub plate, said opening including a planar peripheral lip such that a flexible sealing lid can be place over said opening forming a closed box to seal said pan wherein said handle is concealed below said rub plate.

2. A paint pan comprising:

a generally rectangular box shape with a rectangular floor and four walls extending upwardly from the floor to create the box shape;

a recess formed in a front wall;

a handle is formed in the recess;

a rub plate extends at a downward inclination angle starting near a top edge of a front wall and extending down into the pan towards a back wall and the rectangular floor, the rub plate terminates short of the back wall, and ribs are formed on the rub plate for engaging a roller paint brush and squeezing excess paint from the roller brush, the lateral edges of the rub plate being joined to left and right walls for support;

a partial roof extending from a top edge of the back wall and along the left and right wall for a distance, a recess formed in the partial roof for holding a roller brush;

an opening, said opening formed generally above the rub plate and between the top edge of the front wall and the partial roof, so that, when the pan is in a "use" position, the floor is disposed in a horizontal position and paint may be poured into the pan through the partial open roof and it will flow to the floor;

the pan being dimensioned so that a roller brush may be inserted through the partial opening to the floor of the pan beneath the partial roof to pick up the paint within the pan and squeeze the excess paint from the brush by rolling the brush on the ribs of the rub plate with room provided between the rub plate and the partial roof to allow a variety of roller brush sizes to pass into the pan conveniently said opening including a planar peripheral lip such that a flexible sealing lid can be place over said opening forming a closed box to seal said pan wherein said handle is enclosed in said front wall below said rub plate.

3. The pan of claim 2 wherein the pan is configured so that the pan may be carried by grasping the handle and lifting the pan, and when lifted, the pan will tilt until the floor is vertical and wherein said handle is in the form of a cylinder so that the surface of the handle will allow the pan to rotate about an axis of the handle as the pan is lifted.

4. The pan of claim 2 further comprising a drain hole in a wall immediately adjacent the floor and a plug configured to be inserted and fixed in the hole and wherein the planar rectangular floor includes a first portion in said reservoir and a second portion below said rub plate and wherein one of said left or right walls includes an opening below said rub plate into a tool storage compartment wherein said second portion of said rectangular floor forms a portion of said tool storage compartment.

5. The pan of claim 4 further comprising a locking mechanism to lock the plug in position so that it is not accidentally removed while the pan is in use.

6. The pan of claim 2 further comprising mounts in the four corners of the floor to provide level sturdy mounting positions for pan supports.

7. A paint pan comprising:

a generally rectangular box shape with a rectangular floor and four walls extending upwardly from the floor to create the box shape;

a recess formed in a front wall;

a handle is enclosed in the recess;

a rub plate extends at a downward inclination angle starting near a top edge of a front wall and extending down into the pan towards a back wall and the rectangular floor, the rub plate terminates short of the back wall at the floor, and ribs are formed on the rub plate for engaging a roller paint brush, a partial roof extending from a top edge of the back wall and along the left and right wall for a distance of about one third of the distance from the back wall to the front wall, a recess formed in the pan for holding a roller brush;

an opening formed generally above the rub plate and between the top edge of the front wall and the partial roof, so that, when the pan is in a first position, the floor is disposed in a horizontal position and paint may be poured into the pan through the partial open roof and it will flow to the floor;

the pan being dimensioned so that a roller brush may be inserted through the partial opening to the floor of the pan beneath the partial roof to pick up the paint, said opening including a planar peripheral lip such that a flexible sealing lid can be place over said opening forming a closed box to seal said pan.

8. The pan of claim 7 wherein the pan is configured so that the pan may be carried by grasping the handle and lifting the pan, and when lifted, the pan orient from said first position a second position, and wherein said handle is in the form of a cylinder so that the surface of the handle will allow the pan to rotate about an axis of the handle as the pan is lifted and an enclosed tool storage compartment below said rub plate accessible through an opening in a side wall.

9. The pan of claim 8 further comprising a drain hole in a wall immediately adjacent the floor and a plug configured to be inserted and fixed in the hole and wherein the planar rectangular floor includes a first portion in said reservoir and a second portion below said rub plate andwherein said second portion of said rectangular floor and said handle enclosure forms a portion of said enclosed tool storage compartment.

10. The pan of claim 9 further comprising a locking mechanism to lock the plug in position so that it is not accidentally removed while the pan is in use.

* * * * *